US006397033B1

(12) United States Patent
Todome

(10) Patent No.: US 6,397,033 B1
(45) Date of Patent: May 28, 2002

(54) BELT CONVEYOR WITH REGULATION MEMBER TO REGULATE MOVEMENT OF CONVEYOR BELT, AND IMAGE FORMING APPARATUS EQUIPPED THEREWITH

(75) Inventor: Tsuyoshi Todome, Kanagawa-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/662,142

(22) Filed: Sep. 14, 2000

(30) Foreign Application Priority Data

Sep. 29, 1999 (JP) ..... 11-275536

(51) Int. Cl.[7] ..... G03G 15/01
(52) U.S. Cl. ..... 399/303; 399/165
(58) Field of Search ..... 399/165, 303; 198/839, 840

(56) References Cited

U.S. PATENT DOCUMENTS 4,367,031 A * 1/1983 Hamaker ..... 399/165
4,657,370 A * 4/1987 Forbes et al. ..... 399/165
5,383,006 A * 1/1995 Castelli ..... 399/165
5,481,338 A 1/1996 Todome ..... 355/212
5,740,511 A * 4/1998 Todome ..... 399/303
6,078,766 A * 6/2000 Kurotaka ..... 399/165
6,088,566 A * 7/2000 Todome ..... 399/303

FOREIGN PATENT DOCUMENTS

JP 64-2070 1/1989

* cited by examiner

*Primary Examiner*—Fred L Braun
(74) *Attorney, Agent, or Firm*—Foley & Lardner

(57) ABSTRACT

A belt conveyor includes a driving roller, a driven roller, a conveyor belt wound around the driving roller and driven roller to run endlessly by rotation of the driving roller, and a pair of regulation members arranged adjacent to both the ends of the axial direction of the driving roller to regulate movement of the conveyor belt in the axial direction of the driving roller. The conveyor belt has a conveying portion which conveys an image receiving medium and a returning portion which returns from an ending position of the conveying portion to a starting position of the conveying portion. The pair of regulation members each have a regulating surface that is arranged at a position able to contact a side edge of the conveyor belt at only the returning portion side of the conveyor belt below a middle position between the conveying portion and the returning position where the conveyor belt winds around the driving roller.

16 Claims, 12 Drawing Sheets

| STARTING ANGLE AT WHICH THE REGULATING PLATE STARTS CONTACTING THE BELT FROM THE VERTICAL POSITION | 0° | 15° | 30° | 45° | 60° | 75° | 90° | 105° | 120° | 135° | 150° |
|---|---|---|---|---|---|---|---|---|---|---|---|
| STATUS | | | | | | | | | | | |
| POSITION WHERE A CONCAVE OCCURS | UPPER SURFACE | UPPER SURFACE | UPPER SURFACE | UPPER SURFACE | UPPER SURFACE | UPPER SURFACE | LOWER SURFACE | LOWER SURFACE | LOWER SURFACE | LOWER SURFACE | LOWER SURFACE |

| STARTING ANGLE AT WHICH THE REGULATING PLATE STARTS CONTACTING THE BELT FROM THE VERTICAL POSITION | 0° | 15° | 30° | 45° | 60° | 75° | 90° | 105° | 120° | 135° | 150° |
|---|---|---|---|---|---|---|---|---|---|---|---|
| STATUS | | | | | | | | | | | |
| POSITION WHERE A CONCAVE OCCURS | UPPER SURFACE | UPPER SURFACE | UPPER SURFACE | UPPER SURFACE | UPPER SURFACE | UPPER SURFACE | LOWER SURFACE | LOWER SURFACE | LOWER SURFACE | LOWER SURFACE | LOWER SURFACE |

| STARTING ANGLE AT WHICH THE REGULATING PLATE STARTS CONTACTING THE BELT FROM THE VERTICAL POSITION | 0° | 15° | 30° | 45° | 60° | 75° | 90° | 105° | 120° | 135° | 150° |
|---|---|---|---|---|---|---|---|---|---|---|---|
| STATUS | | | | | | | | | | | |
| POSITION WHERE A CONCAVE OCCURS | UPPER SURFACE | UPPER SURFACE | UPPER SURFACE | UPPER SURFACE | UPPER SURFACE | UPPER SURFACE | LOWER SURFACE | LOWER SURFACE | LOWER SURFACE | LOWER SURFACE | LOWER SURFACE |

BELT CONVEYOR WITH REGULATION MEMBER TO REGULATE MOVEMENT OF CONVEYOR BELT, AND IMAGE FORMING APPARATUS EQUIPPED THEREWITH

BACKGROUND OF THE INVENTION

1. Field of the Invention

The present invention relates to a belt conveyor that conveys an image receiving medium held on a conveying belt to a developed image formed on an image carrier, and an image forming apparatus that transfers the developed image onto the image receiving medium conveyed by the belt conveyor and thereby forms an image onto the image receiving medium.

2. Description of the Related Art

In these years, demands for color printing has been increasing in offices, and accordingly color copiers are spreading widely. As one of these color copiers, for example, well known is a 4-drum tandem type color copier. In this type of color copier, toner images of respective colors are formed on 4 tandem photosensitive drums, and toner images of respective colors are transferred and lapped one after another onto a image receiving medium that is transferred via a conveyor belt, and transferred toner images of respective colors are melted and fixed, thereby a color image is output on the image receiving medium.

In more details, toner images of yellow, magenta, cyan, and black are formed on the surface of 4 photosensitive drums. The image receiving medium is electro statically sucked onto the conveyor belt that is rolled over the surface of respective photosensitive drums and run endlessly, and thereby conveyed, and transfer electric fields are formed by transfer means including transferring rollers and transfer brushes and so forth that are arranged to surfaces of the respective photosensitive drums. By these transfer electric fields, toner images of respective colors are piled one after another and transferred onto the image receiving medium, thereby a color image is output onto the image receiving medium.

However, in the prior art, as mentioned above, it was extremely difficult to transfer toner images of 4 colors, i.e., yellow, magenta, cyan and black onto a image receiving medium with their respective transfer positions arranged accurately, accordingly it was hard to output a quality image without color displacement, which has been a problem in the prior art.

SUMMARY OF THE INVENTION

Accordingly, the object of the present invention is to provide a belt conveyor that may make a conveyor belt to convey a image receiving medium stably run at a specified position, and an image forming apparatus that is equipped with the belt conveyor, and may remove image displacement output on the image receiving medium that is conveyed via the belt conveyor, and form quality images.

According to the present invention, there is provided a belt conveyor comprising a driving roller; a driven roller arranged roughly in parallel with, and away from the driving roller; a conveyor belt wound around the driving roller and driven roller, to run endlessly by rotation of the driving roller; and a regulation member arranged adjacent to at least one end of the axial direction of the driving roller, to regulate the moving of the conveyor belt in the axial direction of the driving roller; wherein the regulation member has a regulating surface that may slide on and contact to a lower part portion in a range where the conveyor belt contacts the driving roller.

Further, according to the present invention, there is provided an image forming apparatus comprising a driving roller; a driven roller arranged roughly in parallel with, and away from the driving roller; a conveyor belt wound around the driving roller and driven roller, and has a transfer surface to hold an image receiving medium, to run endlessly by rotation of the driving roller; regulation members arranged adjacent to both the ends of the axial direction of the driving roller, to regulate the moving of the conveyor belt in the axial direction of the driving roller; plural image carriers arranged to the conveying surface of the conveyor belt and along the running direction; image forming means for forming a developed image on each of the image carriers; and transfer means for transferring the developed image onto the image receiving medium that is held by the conveying surface and made to go through the plural image carriers; wherein the regulation members have regulating surfaces that may slide on and contact to lower parts in ranges where the conveyor belt contacts the driving roller.

DETAILED DESCRIPTION OF THE PREFERRED EMBODIMENTS

The invention is illustrated in more details by reference to the following referential examples and preferred embodiments wherein.

Figure 1:
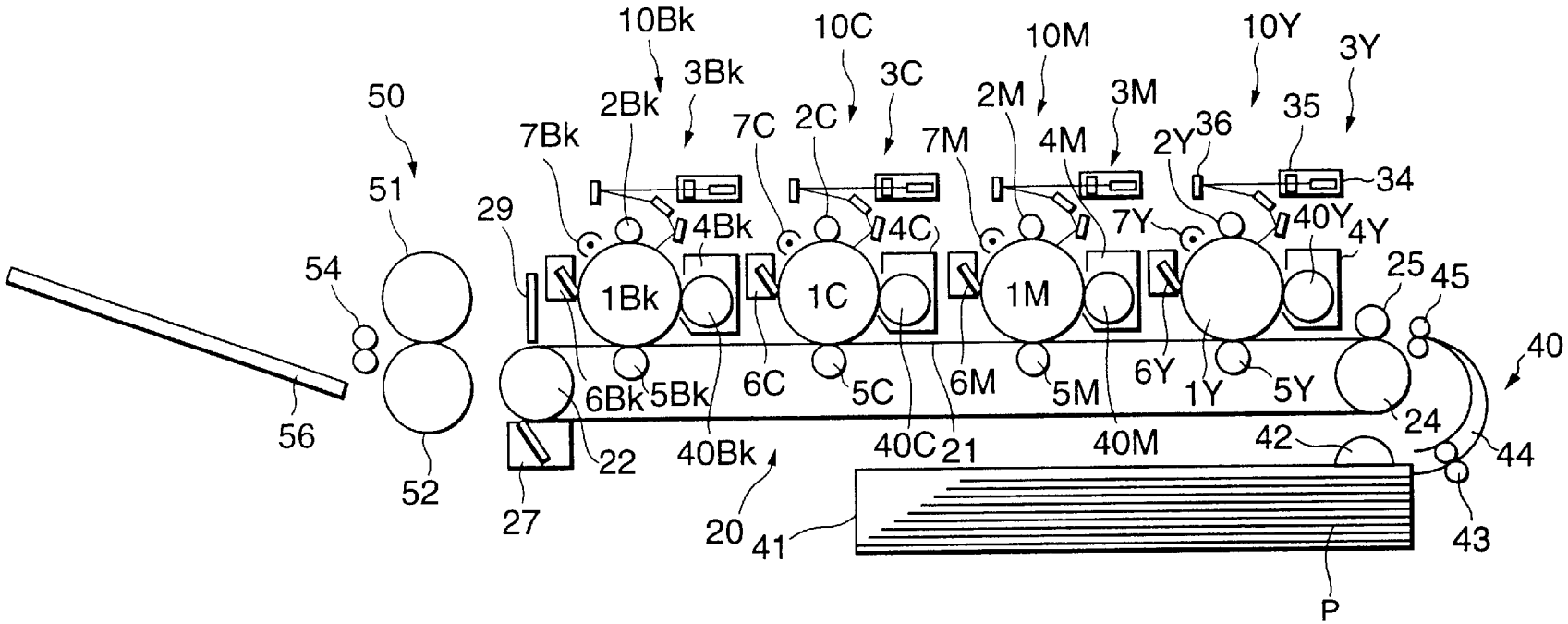
FIG. 1 is a schematic diagram showing a structure of an important portion of an image forming apparatus according to a preferred, embodiment under the present invention.

In FIG. 1, shown as an image forming apparatus under a preferred embodiment of the present invention is a structure of an important portion of a 4 tandem type full color copier.

This color copier has 4 photosensitive drums (image carriers) 1Y, 1M, 1C and 1Bk that are arranged along a roughly horizontal direction with specific intervals. Around the respective photosensitive drums 1Y, 1M, 1C and 1Bk, arranged are plural image forming units (image forming means) 10Y, 10M, 10C and 10Bk that form images of corresponding colors on the respective photosensitive drums 1Y, 1M, 1C and 1Bk. And under the respective photosensitive drums 1Y, 1M, 1C and 1Bk, arranged are a conveying mechanism 20 as a belt conveyor under the present invention for conveying a image receiving medium P along the surface of each photosensitive drum.

The conveying mechanism 20 has a driving roller 22 and a driven roller 24 that are away from each other in roughly horizontal direction, and between this pair of rollers 22 and 24, arranged is an endless conveyor belt 21. Inside of the conveyor belt 21, arranged are 4 transferring rollers (transfer means) 5Y, 5M, 5C and 5Bk to the respective photosensitive drums 1Y, 1M, 1C and 1Bk.

Each of the respective image forming units 10Y, 10M, 10C and 10Bk is equipped with main chargers 2Y, 2M, 2C and 2Bk, laser systems 3Y, 3M, 3C and 3Bk, developing devices 4Y, 4M, 4C and 4Bk, cleaners 6Y, 6M, 6C and 6Bk, charge removers 7Y, 7M, 7C and 7Bk.

Herein, as one example, the yellow image forming unit 10Y is described in details.

Figure 2:
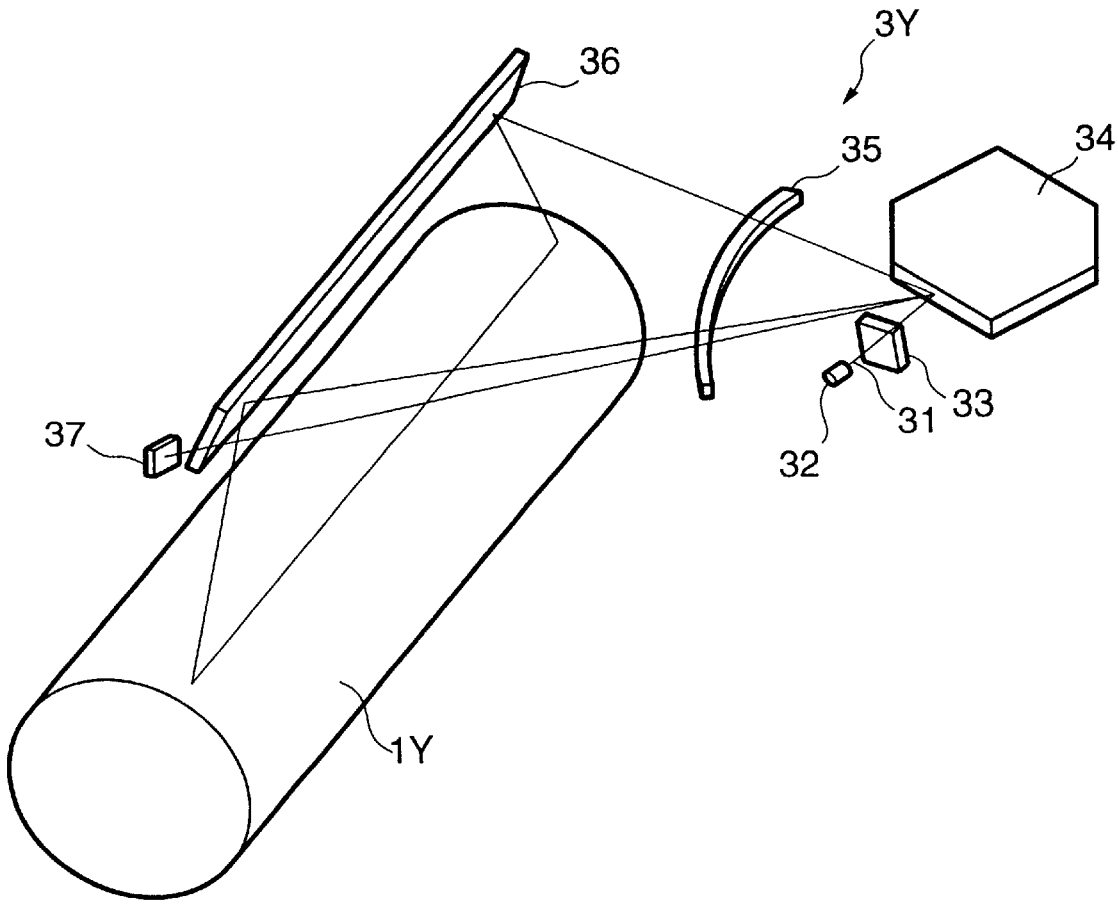
FIG. 2 is a schematic diagonal view showing a laser optical system for yellow built in the image forming apparatus shown in FIG. 1.

As shown in FIG. 2, in the yellow laser optical system 3Y, on the basis of image data coming in from external devices and so forth, a semiconductor laser generator 32 is driven by a printing signal that is sent from a printing control portion not illustrated herein, and laser beam 31 is output. This output beam light 31 is shaped by a beam shaping optical system comprising for instance a cylindrical lens 33 or so, and is polarized by a polygon mirror 34 as a rotating polygon mirror that is rotated by a high speed motor not illustrated herein.

The polarized beam light 31 goes through an fθ lens 35, and is reflected by a reflection mirror 36, and thereby forms a spot having a necessary resolution at a specified exposure position on the photosensitive drum 1Y, and then scanned and exposed, thereby forms a electrostatic latent image on the photosensitive drum 1Y. And the polarized beam light 31 is detected by a beam detector 37 comprising a photo diode, and thereby synchronization of main scanning direction (horizontal direction).

Now back to FIG. 1, around the photosensitive drum 1Y, arranged are a main charger 2Y that charges the surface of the photosensitive drum 1Y, the above mentioned laser optical system 3Y, a developing device 4Y, a transferring roller 5Y, a cleaner 6Y and a charge remover 7Y.

The photosensitive drum 1Y is rotated at external circumferential speed Vo by a driving motor not illustrated herein. The surface of this photosensitive drum 1Y is charged by a main charger 2Y comprising a charging roller having electric conductivity that is arranged to the surface concerned. By the way, this charging roller rotates, by contacting the surface of the photosensitive drum 1Y.

The surface of the photosensitive drum 1Y is formed with organic system photo conductive material. This photo conductive material is normally at high resistance, but once light is radiated onto it, the specific resistance of its light radiation portion will change. Therefore, by irradiating light corresponding to yellow printing pattern via the laser optical system 3Y onto the surface of the charged yellow photosensitive drum 1Y, the electrostatic latent image of yellow printing pattern is formed on the surface of the photosensitive drum 1Y.

An electrostatic latent image is one that is formed on the surface of the photosensitive drum 1Y by charging. Namely, by light radiation from the laser optical system 3Y, the specific resistance of the radiated portion of photo conductive material decreases, charged electric charge of the surface of the photosensitive drum 1Y flows, and electric charge remains at the portion which was not light radiated by the laser optical system 3Y, thereby, an electrostatic latent image is formed. This is what is called a negative latent image.

In this manner, the photosensitive drum 1Y where an electrostatic latent image has been formed rotates to the specific developing position at circumferential speed Vo. And at this developing position, the electrostatic latent image on the photosensitive drum 1Y is toner imaged as a visible image by the developing device 4Y.

Contained in the developing device 4Y is a yellow toner that contains yellow dye and is formed by resin. The yellow toner is abrasion charged by being stirred by a developing roller 40Y in the developing device 4Y, and thereby has electric charge of the same polarity as charged electric charge on the photosensitive drum 1Y. As the surface of the photosensitive drum 1Y goes through the developing device 4Y, yellow toner attaches in electrostatic manner only to the latent image portion where electric charge has been removed, and a electrostatic latent image is developed by yellow toner (in reverse development).

The photosensitive drum 1Y where a yellow toner image has been formed continuously rotates at circumferential speed Vo, by the transferring roller 5Y at a specified transfer position, a toner image is transferred onto an image receiving medium P that is supplied timingly by paper supply system described later herein. The image receiving medium P, being held on the conveyor belt 21 of the conveying mechanism 20, is sent to the transfer position.

The paper supply system 40 for supplying the image receiving medium P has a paper supply cassette 41, a pickup roller 42, a feed roller 43, a paper supply guide 44, and an aligning roller 45.

Only one sheet of the image receiving medium P that is taken out of the paper supply cassette 41 by the pickup roller 42 is conveyed by the feed roller 43 along the paper supply guide 44 to the aligning roller 45. The aligning roller 45 positions the image receiving medium P correctly, then sends the image receiving medium P to a suction roller 25 on the conveyor belt 21. The external circumferential speed of the aligning roller 45 and the circumferential speed of the conveyor belt 21 are set so as to be equal to the circumferential speed Vo of the photosensitive drum 1Y. The image receiving medium P, whose part being held by the aligning roller 45, is conveyed to between the suction roller 25 and the conveyor belt 21. At that position, the image receiving medium P is charged by electric charge, and thereby is statically sucked onto the conveyor belt 21 in electro static manner, and is sent along with the conveyor belt 21 that runs at the same speed Vo of that of the photosensitive drum 1Y to the transfer position of the photosensitive drum 1Y.

At the transfer position, the yellow toner image on the photosensitive drum 1Y that contacts the image receiving medium P is released from the photosensitive drum 1Y and transferred to the image receiving medium P by the transferring roller 5Y. As the result, a yellow toner image of printing pattern based on yellow printing signal is formed on the image receiving medium P.

The transferring roller 5Y comprises raw material having electric conductivity. From the back side of the conveyor 21, this transferring roller 5Y supplies an electric field having polarity opposite to the electric charge of yellow toner statically attaching onto the photosensitive drum 1Y. This electric field works through the conveyor belt 21 and the image receiving medium P to the yellow toner image on the photosensitive drum 1Y, consequently, the electric field transfers the toner image from the photosensitive drum 1Y to the image receiving medium P.

In this manner, the image receiving medium P that has transferred the yellow toner image is made to pass a magenta image forming unit 10M, cyan image forming unit 10C and black image forming unit 10Bk in order. The magenta image forming unit 10M, cyan image forming unit 10C and black image forming unit 10Bk respectively comprise of same structure components and workings with only replacement of yellow (Y) in the above-mentioned yellow image forming unit 10Y by magenta (M), cyan (C) and black (Bk), therefore, detailed explanations about these image forming units are omitted herein.

Now, the image receiving medium P that passed the yellow transfer position, magenta transfer position, cyan transfer position and black transfer position in this order, is then sent into a fixing device 50.

The fixing device 50 has a heat roller 51 incorporating a heater not illustrated herein and a pressing roller 52, and heats up the toner image that is only positioned on the image receiving medium P by electric charge, thereby melts color lapped toner image, and permanently fixes the toner image onto the image receiving medium P. The image receiving medium P after completion of fixation is carried out to a receiving tray 56 by an exit roller 54.

On the other hand, the respective photosensitive drums 1Y, 1M, 1C and 1Bk that have passed the transfer position, are rotated and driven at circumferential speed Vo as well as before, and remaining toner and paper powder are cleaned off them by the cleaners 6Y, 6M, 6C and 6Bk. And further, the electric charge on the surface is made uniform by charge remover lamps of charge removers 7Y, 7M, 7C and 7Bk, and at necessity, a series of processes from the main chargers 2Y, 2M, 2C and 2Bk is carried out.

While, as for the conveyor belt 21, after sending out the image receiving medium P to the fixing device 50, remaining toner and paper powder attaching onto the belt surface are cleaned off by a belt cleaner 27, and at necessity a next image receiving medium P is conveyed.

By the way, in the case of single color printing, image forming is carried out by the above-mentioned optional single color image forming unit. In this case, other image forming units than selected do not carry out their actions.

In the next place, the above mentioned conveying mechanism 20 is explained in detail hereinafter.

Figure 3:
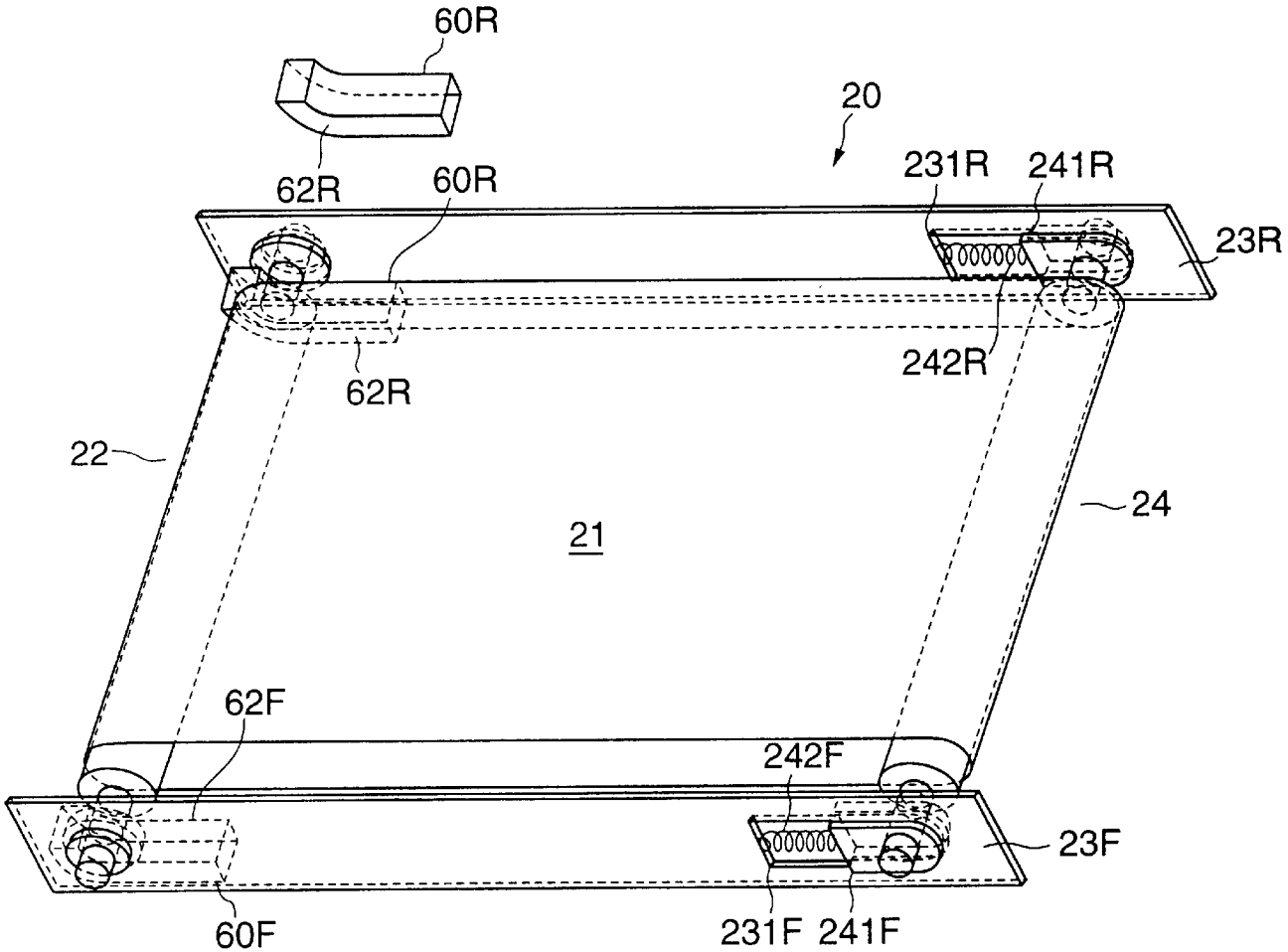
FIG. 3 Is a diagonal view showing a transfer mechanism according to the above first preferred embodiment built in the image forming apparatus shown in FIG. 1.

As shown in FIG. 3, the conveying mechanism 20 has a driving roller 22 and a driven roller 24 that are away from each other in roughly horizontal direction. And between this pair of rollers 22 and 24, arranged is an endless conveyor belt 21.

Each end at the front side and the rear side of the rotating shafts of the respective rollers 22 and 24 is rotatably arranged to a pair of belt frames 23F and 23R which are of roughly rectangular shape respectively. At the portion where the rotating shaft of the driven roller 24 of the belt frames 23F and 23R, formed are slide holes 231F and 231R wherein bearings 241F and 241F arranged at both ends of the rotating shaft are engaged so as to move in roughly horizontal direction, namely along the running direction of the conveyor belt 21. Respective bearings 241F and 241F are equipped with springs 242F and 242R, and a driven roller 24 is energized in the direction away from the driving roller 22. Thereby, a specified tension is given to the conveyor belt 21 arranged between the respective rollers 22 and 24.

In the above conveying mechanism 20, to make the conveyor belt 21 run precisely on specified position, and for the conveyor belt 21 to keep the conveyor surface to the respective photosensitive drums 1Y, 1M, 1C and 1Bk roughly in horizontal manner, is important so as to obtain quality transfer of toner image to image receiving medium.

However, the conveyor belt 21 generally has unevenness in the thickness thereof, and the length at both the ends along the running direction thereof is slightly different, so the conveyor belt 21 is displaced to one side in the direction crossing the running direction during running, that is, in the shaft direction of the respective rollers 22 and 24, which is known by those skilled in the art. As for the direction where the conveyor belt 21 displaces (front side or rear side), there is difference among conveyor belts 21, and the arrangement direction of the conveyor belt 21 between rollers 22 and 24 also makes difference.

In any way, when the conveyor belt 21 is run displaced to one side in shaft direction, the image receiving medium that is sucked to the conveyor surface of the conveyor belt 21 is conveyed displaced to one side in shaft direction, and in case of large displacement degree, color displacement is caused.

Therefore, in the present invention, so as to make the conveyor belt 21 run at specified position in stable manner, arranged is a structure that is explained in detail hereinafter.

According to a first preferred embodiment of the present invention, regulation members 60F and 60R are arranged adjacent to both the ends of the rotating shaft of the driving roller 22 so as to regulate the movement of the conveyor belt 21 to the shaft direction of the driving roller 22. The respective regulation members 60F and 60R are fixed to the insides of the belt frames 23F and 23R at the position adjacent to both the ends of the driving roller 22, and have regulating surfaces 62F and 62R so as to regulate the movement of the conveyor belt 21 to the belt frame side at end corresponding by sliding both ends along the conveyor direction.

The distance between the regulating surfaces 62F and 62R of the respective regulation members 60F and 60R is set so as to be slightly wider than the width along the shaft direction of the conveyor belt 21. And the regulating surfaces 62F and 62R of the respective regulation members 60F and 60R is set at the position where the conveyor belt 21 slides and contacts the corresponding end of the conveyor belt 21 at downstream side than the central position along the running direction in the range where the conveyor belt 21 contacts the external circumferential surface of the driving roller 22. Namely, the respective regulating surfaces 62F and 62R is set so as to slide and contact both the ends of the conveyor belt 21 at the lower portion of the conveyor belt 21 that is run from the driving roller 22 toward the driven roller 24.

In this manner, the respective regulation members 60F and 60R are arranged adjacent to both the ends of the driving roller 22, thereby when the conveyor-belt 21 starts displacing to one side in axial direction during running, the end of the displaced side of the conveyor belt 21 is slid and contacted to the regulating surface of the corresponding regulation member, and at this position, the movement of the conveyor belt 21 to the axial direction of the driving roller 22 is regulated, as a consequence, the running position of the conveyor belt 21 is stabilized.

It is known that, however, regulation members are slid and contacted to end of the conveyor belt 21, its stress is transmitted to position away from the end of the conveyor belt 21, and a concave is caused at the position. For example, when there is a concave caused at the portion (upper portion) of the conveyor belt 21 at the side wherein contact is made to the respective photosensitive drums running from the driven roller 24 toward the driving roller 22 (image receiving medium conveyance side), waving is caused on-the conveyance surface at upper portion where this concave is made, waving is also caused on image receiving medium that is conveyed on the transfer surface with the original waving, and surface position of image receiving medium changes, causing color displacement. Namely, so as to form a quality image, it is indispensable not to make a concave on the upper portion of the conveyor belt 21.

The position of a concave arising on the conveyor belt 21 when regulation members are slid and contacted to end of the conveyor belt 21 changes with the position where the regulating surface of regulation member slides and contacts to the end of the upper conveyor belt 21. For instance, when regulation member is slid and contacted to the end of the conveyor belt 21, as mentioned above, a concave is made at the upper portion of the conveyor belt 21. That is because the pressing pressure by regulation member used at the end of the upper portion of the conveyor belt 21 is transmitted more to the upper portion of the conveyor belt 21, than to the lower portion of the conveyor belt 21 at the side where image receiving medium is not conveyed from the driving roller 22 toward the driven roller 24. Herein, so as to investigate the position of regulating surface where there should be no concave on the upper portion of the conveyor belt 21, an experiment has been conducted as described hereinafter.

Figure 4:
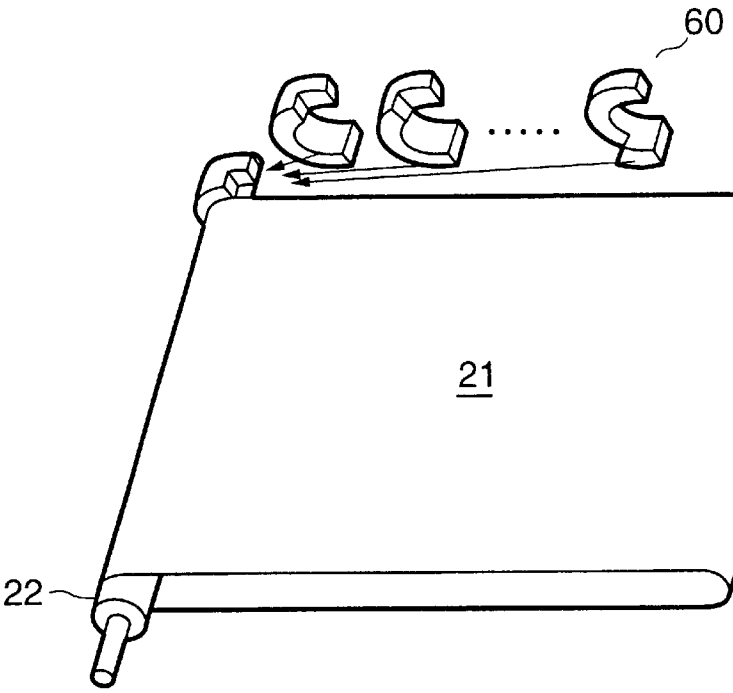
FIG. 4 is a diagram to show an experiment to investigate appropriate positions of the regulating surface of the regulation member by the transfer mechanism shown in FIG. 3.

In this experiment, prepared are 11 kinds of regulation members 60 as shown in the table in FIG. 4, and the positions of concave on the conveyor belt 21 were investigated when respective regulation members 60 were arranged at both the ends of the driving roller. At this moment, the regulating surface of the respective regulation members 60 were set as of the shape shown in slash lines in FIG. 4, and the regulating surface was set so as to slide and contact to the end of the conveyor belt 21 in the position relations shown in the table. Namely, the position where the conveyor belt 21 starts sliding and contacting to the regulating surface was changed by 15 degrees to the downstream side-along the running direction of the conveyor belt 21 from the top position where the conveyor belt 21 starts contacting to the driving roller 22.

As a result, it was found that there will be a concave or waving on the upper portion (upper surface) when the conveyor belt 21 is at the upstream side along the running direction of the conveyor belt 21 than the central position along the running direction of the semi circular range where the conveyor belt 21 contacts the driving roller 22 and the end of the conveyor belt 21 slides and contacts to the regulating surface of the regulation members. While there occurs a concave on the lower portion (under surface) of the conveyor belt 21 when the conveyor belt 21 is at the downstream side along the running direction of the conveyor belt 21 than the central position of the contact range between the conveyor belt 21 and the driving roller 22 and the regulating surface slides and contacts to the end of the :conveyor belt 21.

On the basis of the experiment results, in the present preferred embodiment, the respective regulating surfaces 62F and 62R were set so that the conveyor belt 21 should on the downstream side than the central position along the running direction in the range where the conveyor belt 21 contacts the driving roller 22, and the respective regulating surfaces 62F and 62R of the respective regulation members 60F and 60R should slide and contact to the end of the conveyor belt 21. Thereby, the pressing pressure working on the end of the conveyor belt 21 by the respective regulating surfaces 62F and 62R prevents a concave from occurring on the upper portion of the conveyor belt 21, and enables to make the conveyor belt 21 run precisely on specified position. And further, it is possible to keep the transfer surface in a roughly horizontal status at the upper portion of the conveyor belt 21, and to output a precise and preferable image onto the image receiving medium that is held and conveyed on the conveyor surface.

By the way, as mentioned above, in the structure wherein the regulating-surfaces 62F and 62R of the respective regulation members 60F and 60R are slid and contacted to the end of the conveyor belt 21, and thereby the movement of the conveyor belt 21, to the shaft direction is regulated, when the twisting force of the conveyor belt 21 to the shaft direction is unexpectedly large, there may be a case where the end of the conveyor belt 21 flips up and goes over the regulating surface. If the end of the conveyor belt 21 goes over the regulating surface as in this case, the movement of the conveyor belt 21 to the shaft direction of the driving roller 22 cannot be regulated, and there will be deformation on the conveyor belt 21 itself, and in worst case, the conveyor belt 21 will be broken.

Figure 5:
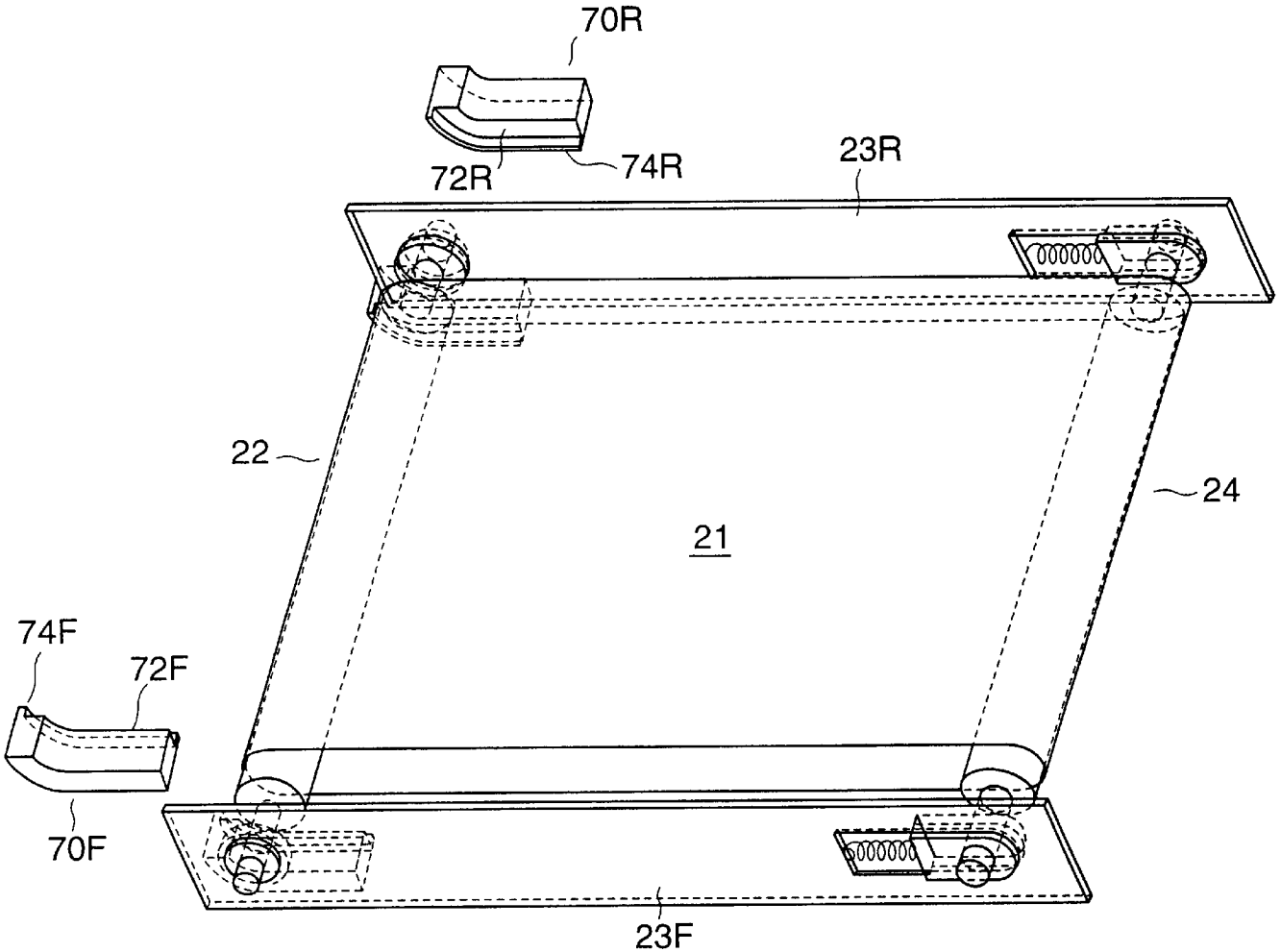
FIG. 5 is a diagonal view showing a structure according to a second preferred embodiment under the present invention.
Figure 6:
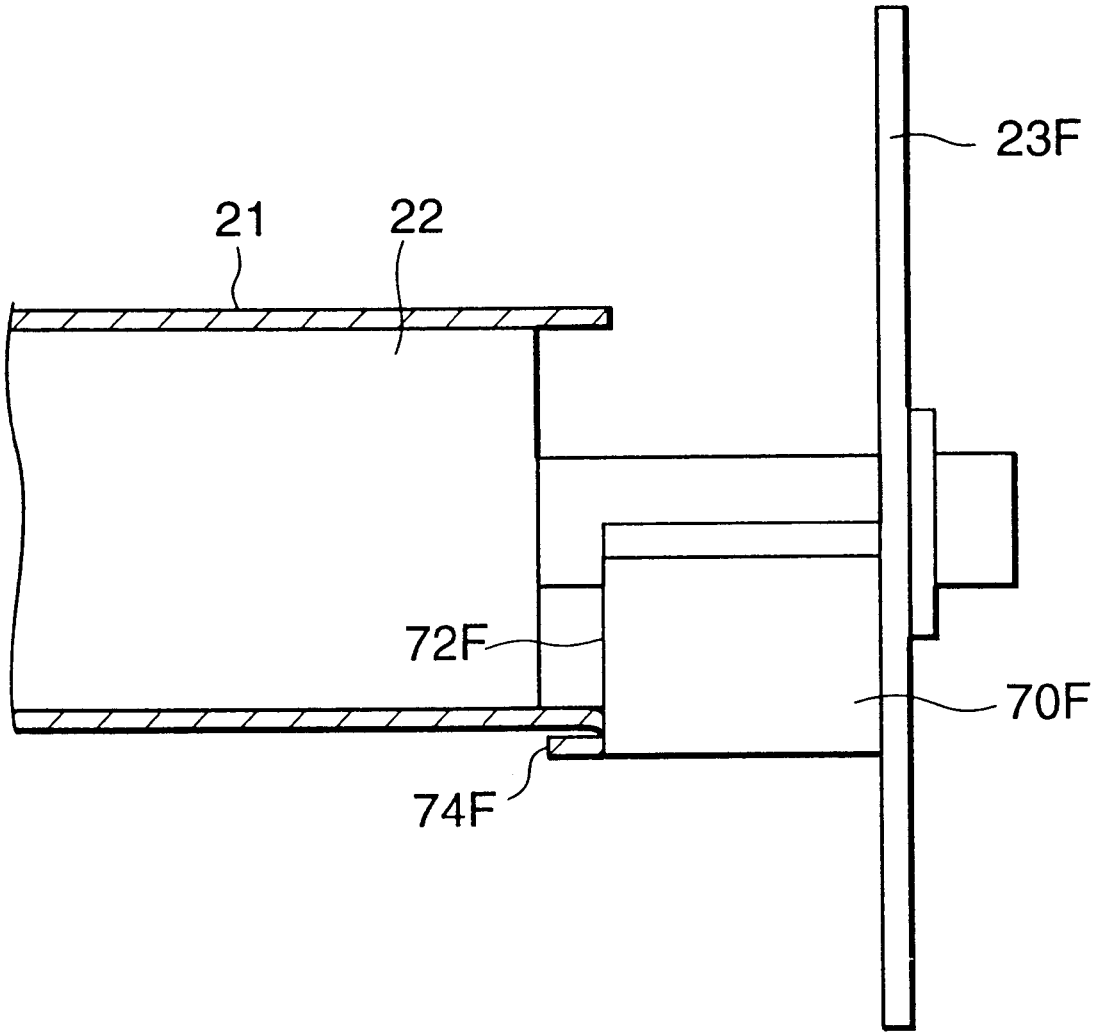
FIG. 6 is a cross sectional view showing details of the important portion of FIG. 5.

To prevent such cases, in a second preferred embodiment under the present invention, as shown in FIG. 5 and FIG. 6, projections 74F and 74R that protruding in eaves share are arranged along the conveyance surface of the conveyor belt 21 from the regulating surfaces 12F and 72R of the regulation members 70F and 70R. Thereby, even if abnormal twisting forth of the conveyor belt 21 is to make flipping of the end of the conveyor belt 21 large, the conveyor belt 21 will not go over the eaves shaped protrusions 74F and 74R. Consequently, it is possible to keep the sliding and contacting status between the regulating surface and the end of the conveyor belt. At the same time, it is possible to prevent the end of the conveyor belt 21 from going over the regulating surface, therefore, there will be no fear of the conveyor belt 21 being broken.

Figure 7:
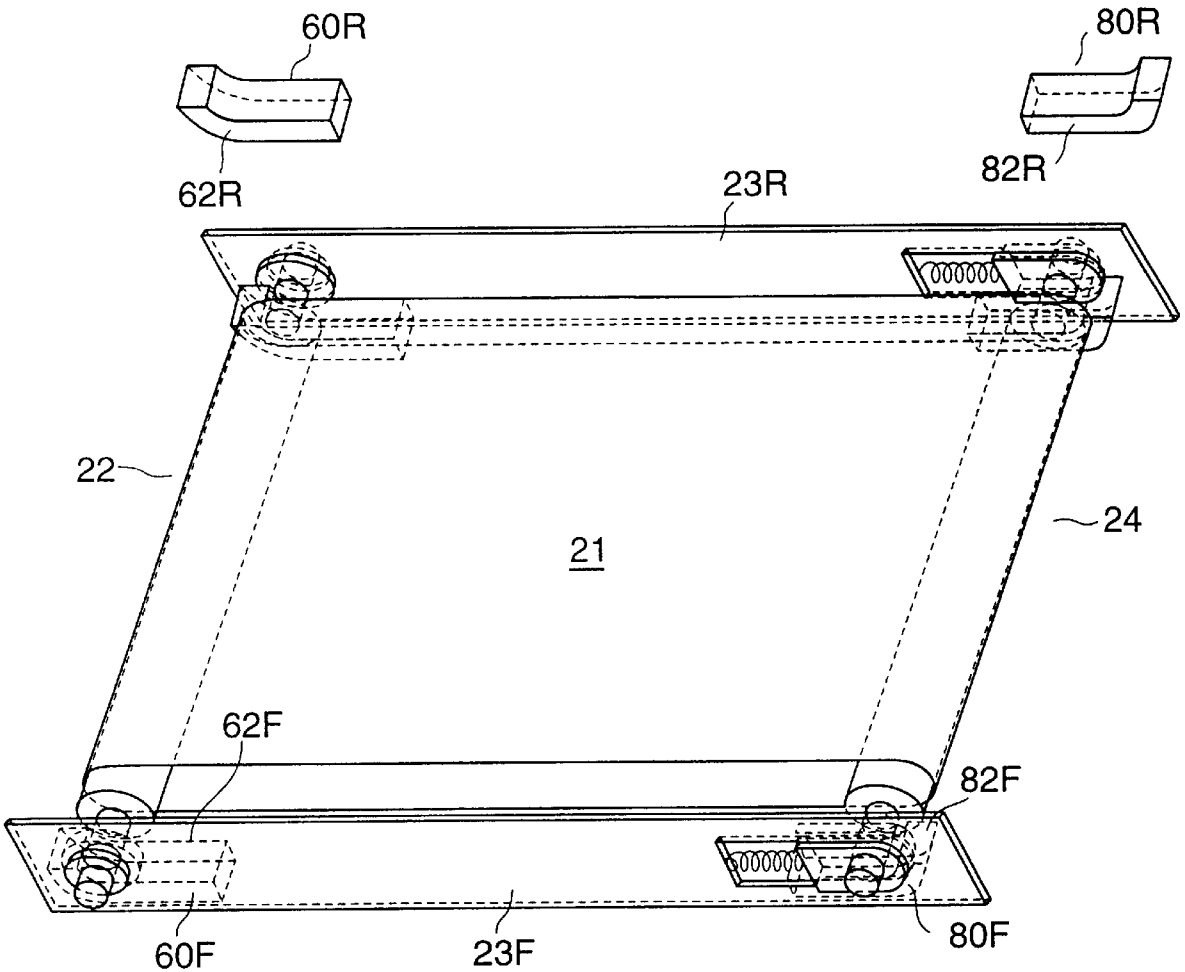
FIG. 7 is a diagonal view showing a structure according to a third preferred embodiment under the present invention.

In FIG. 7, shown is a structure according to a third preferred embodiment under the present invention. In this preferred embodiment, regulation members 80F and 80R similar to the regulation members 60F and 60R in the above first preferred embodiment are arranged adjacent to both the ends of the driven roller 24.

As shown in FIG. 3, in a structure wherein the regulation members 60F and 60R are arranged only at the driving roller 22 side, if twisting force of the conveyor belt 21 to shaft direction is abnormally large, even it is possible to regulate the twisting of the conveyor belt 21 at the driving roller 22 side, it may not be possible to regulate the twisting of the conveyor belt 21 at the driven roller 24 side. In this case, the conveyor belt 21 is forcibly twisted by the regulation members 60F and 60R at the driving roller 22 side. If this status continues, in worst case, the conveyor belt 21 is broken.

For this reason, in this preferred embodiment, the regulation members 60F and 60R of the first preferred embodiment are arranged, and further regulation members 80F and 80R for regulating the movement of the conveyor belt 21 to the shaft direction of the driven roller 24 are arranged adjacent to both the ends of the driven roller 24. The respective regulation members 80F and 80R are fixed to the inside of the belt frames 23F and 23R at the position adjacent to the both ends of the driven roller 24 respectively. The attachment positions of the respective regulation members 80F and 80R may be adjusted in running direction to respectively corresponding belt frames 23F and 23R. And the respective regulation members 80F and 80R have regulating surfaces 82F and 82R for making both the ends along the conveyance direction of the conveyor belt 21 slide and contact and regulating the movement of the conveyor belt to the belt frame side of corresponding end.

The distance between the regulating surfaces 82F and 82R of the respective regulation members 80F and 80R is set so as to be slightly wider than the width along the shaft direction of the conveyor belt 21. And the regulating surfaces 82F and 82R of the respective regulation members 80F and 80R are set at the position where the conveyor belt 21 slides and contacts the corresponding end of the conveyor belt 21 at upstream side than the central position along the running direction in the range where the conveyor belt 21 contacts the external circumferential surface of the driven roller 21. Namely, the respective regulating surfaces 82F and 82R is set so as to slide and contact both the ends of the conveyor belt 21 at the lower portion of the conveyor belt 21 that is run from the driving roller 22 toward the driven roller 24.

In this manner, the respective regulation members 60F and 60R are arranged adjacent to both the ends of the driving roller 22, and further the respective regulation members 80F and 80R are adjacent to both the ends of the driven roller 24, it is possible to regulate the twisting of the conveyor belt 21 along the shaft direction of the driving roller 22 and the driven roller 24 at the driving roller 22 side and the driven roller 24 side, and it is possible to stabilize the running position of the conveyor belt 21.

In this preferred embodiment too, as same as in the aforementioned first preferred embodiment, so as to investigate the position of regulating surface where there should be no concave on the upper portion of the conveyor belt 21 owing to the arrangement of the regulation members 80F and 80R, and so as to find the appropriate positions of the regulating surfaces 82F and 82R, an experiment has been conducted as described hereinafter.

Figure 8:
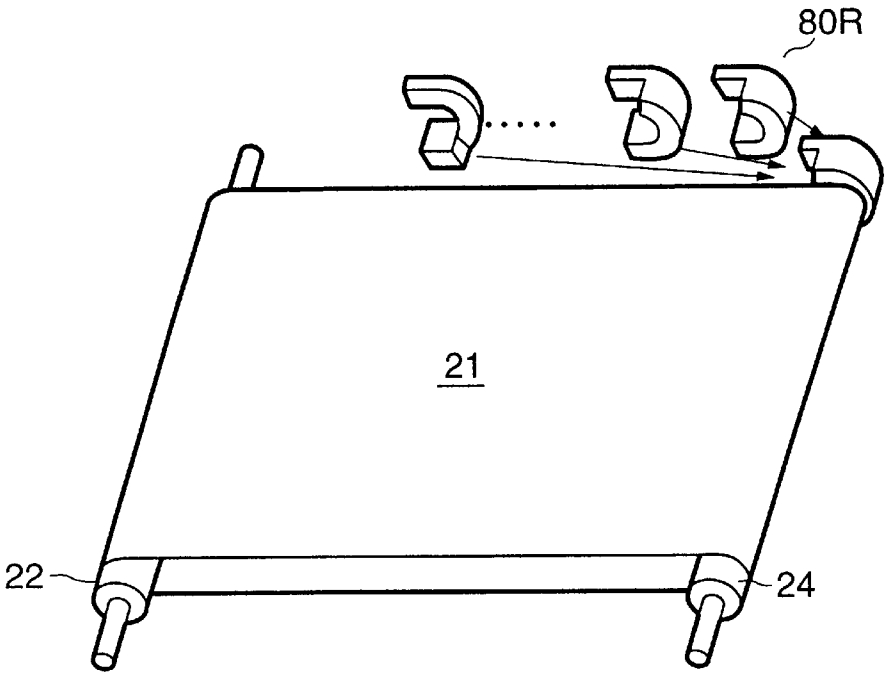
FIG. 8 is a view to explain an experiment to investigate appropriate positions of the regulating surface of the regulation member by the transfer mechanism shown in FIG. 7.

In this experiment, prepared are 11 kinds of regulation members 80R as shown in the table in FIG. 8, and the positions of concave on the conveyor belt 21 were investigated when respective regulation members 80R were arranged at both the ends of the driving roller 24. At this moment, the regulating surface of the respective regulation members 80R were set as of the shape shown in slash lines in FIG. 8, and the regulating surface was set so as to slide and contact to the end of the conveyor belt 21 in the position relations shown in the table. Namely, the position where the conveyor belt 21 finishes sliding and contacting to the regulating surface was changed by 15 degrees to the upstream side in the opposite direction to the running direction of the conveyor belt 21 from the end of the range where the conveyor belt 21 contacts the driven roller 24.

As a result, it was found that there will be a concave on the upper portion (upper surface) when the conveyor belt 21 is at the downstream side along the running direction of the conveyor belt 21 than the central position along the running direction of the semi circular range where the conveyor belt 21 contacts the driven roller 24 and the end of the conveyor belt 21 slides and contacts to the regulating surface of the regulation members. While there occurs a concave on the lower portion (under surface) of the conveyor belt 21 when the conveyor belt 21 is at the upstream side along the running direction of the conveyor belt 21 than the central position of the contact range between the conveyor belt 21 and the driven roller 24 and the regulating surface slides and contacts to the end of the conveyor belt 21.

On the basis of the experiment results, in the present preferred embodiment, the respective regulating surfaces 82F and 82R were set so that the conveyor belt 21 should on the upstream side than the central position along the running direction in the range where the conveyor belt 21 contacts the driven roller 24, and the respective regulating surfaces 82F and 82R of the respective regulation members 80F and 80R should slide and contact to the end of the conveyor belt 21. Thereby, the pressing pressure working on the end of the conveyor belt 21 by the respective regulating surfaces 82F and 82R prevents a concave from occurring on the upper portion of the conveyor belt 21.

As mentioned so far, according to this preferred embodiment under the present invention, four regulation members 60F, 60R, 80F and 80R are arranged adjacent to both the ends of the driving roller 22 and the driven roller 24, it is possible to prevent a concave from occurring on the upper portion of the conveyor belt 21, and further it is possible to prevent unwanted twisting of the conveyor belt 21.

By the way, in such a structure as the third preferred embodiment shown in FIG. 7, when the twisting force of the conveyor belt 21 to the shaft direction of the driving roller 22 and the driven roller 24 is unexpectedly large, there may be a case where the end of the conveyor belt 21 flips up and goes over the regulating surface 62 and 82 of the respective regulation members 60 and 80. If the end of the conveyor belt 21 goes over the regulating surfaces as in this case, the movement of the conveyor belt 21 to the shaft direction cannot be regulated, and there will be deformation on the conveyor belt 21 itself, and in worst case, the conveyor belt 21 will be broken.

Figure 9:
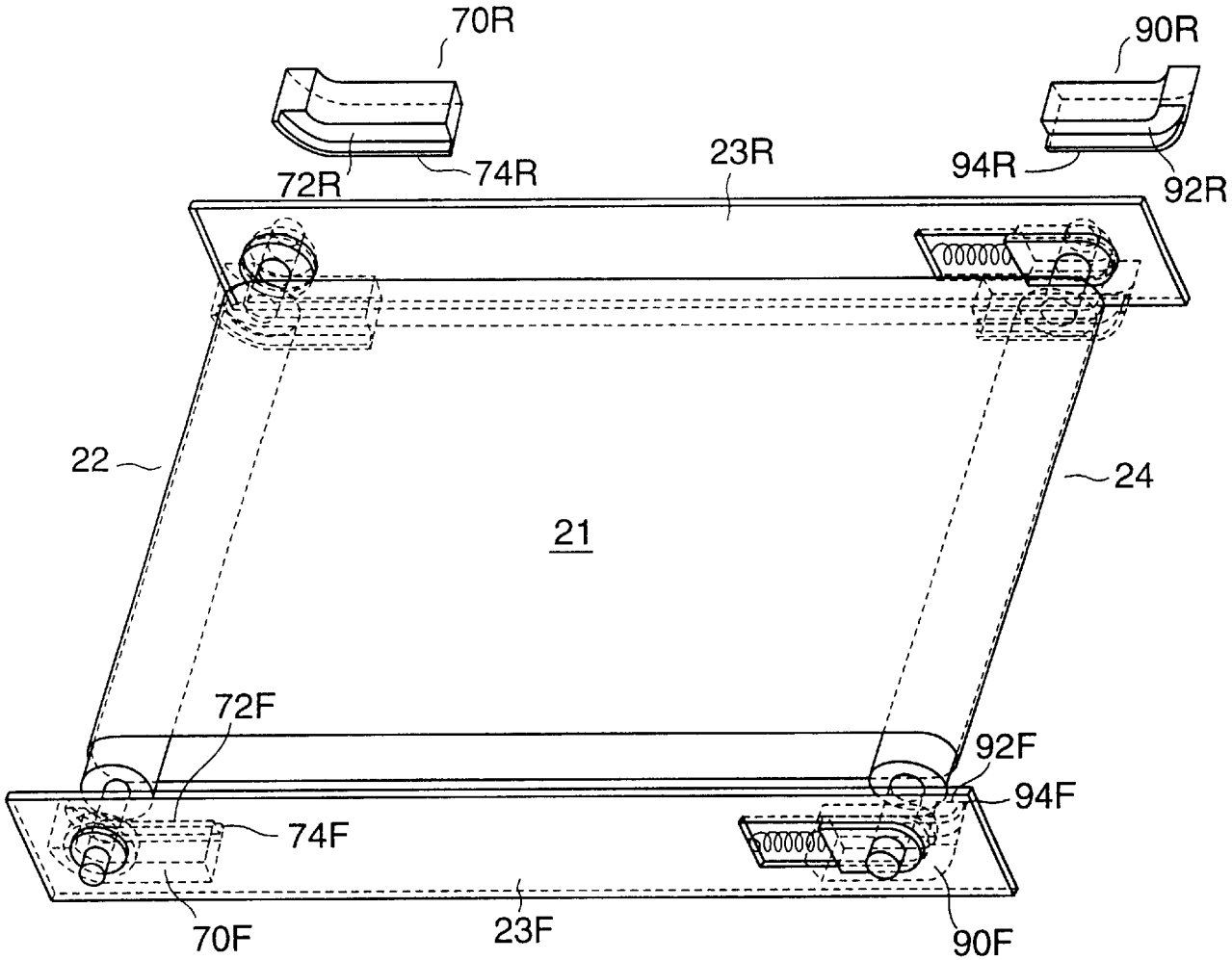
FIG. 9 is a diagonal view showing a structure according to a fourth preferred embodiment under the present invention.

To prevent such cases, in a fourth preferred embodiment under the present invention, as shown in FIG. 9, projections 74F, 74R, 94F and 94R that protruding in eaves shape are arranged along the conveyance surface of the conveyor belt 21 from the respective regulating surfaces 72F, 72R, 92F and 92R of the respective regulation members 70F, 70R, 90F and 90R. Thereby, even if abnormal twisting forth of the conveyor belt 21 is to make flipping of the end of the conveyor belt 21 large, the conveyor belt 21 will not go over the eaves shaped protrusions 74F, 74R, 94F and 94R, consequently, it is possible to keep the sliding and contacting status between the regulating surface and the end of the conveyor belt. At the same time, it is possible to prevent the end of the conveyor belt 21 from going over the regulating surfaces, therefore, there will be no fear of the conveyor belt 21 being broken.

While, in the case where regulation members are arranged respectively on both the ends of the driving roller 22 and the driven roller 24, like in the above-mentioned third and fourth preferred embodiments under the present invention, for example, when the distance along shaft direction between the regulating surface 72R of the regulation member 70R arranged adjacent to the rear side end of the driving roller 22 and the regulating surface 92R of the regulation member 90R arranged adjacent to the rear side end of the driven roller 24 is too large, it leads to the same status where the end of the conveyor belt 21 is regulated by the regulation member of only one roller side, therefore, sufficient effects are not obtained. Further, if the distance between the respective regulating surfaces 72R and 92R is widely open, in worst case, the conveyor belt 21 may be broken. This is same to the regulation members 70F and 90F arranged at the front sides of the respective rollers 22 and 24. In short, ideally, it is preferable to place the regulating surfaces of facing two regulation members along the running direction of the conveyor belt 21 at the same position along shaft direction.

Through this, so as to investigate the distance margin between the above-mentioned regulating surfaces 72R and 92R (hereinafter, only the rear side is described), carried out was the experiment explained hereinafter. In this experiment, the breaking conditions of the conveyor belt 21 were studied by changing the positions of the respective regulating surfaces 72F, 72R, 92F and 92R of the regulation members 70F and 70R at the driving roller 22 side and the regulation members 90F and 90R at the driven roller 24 side, with the thickness of the conveyor belt 21 as parameter.

Figure 10:
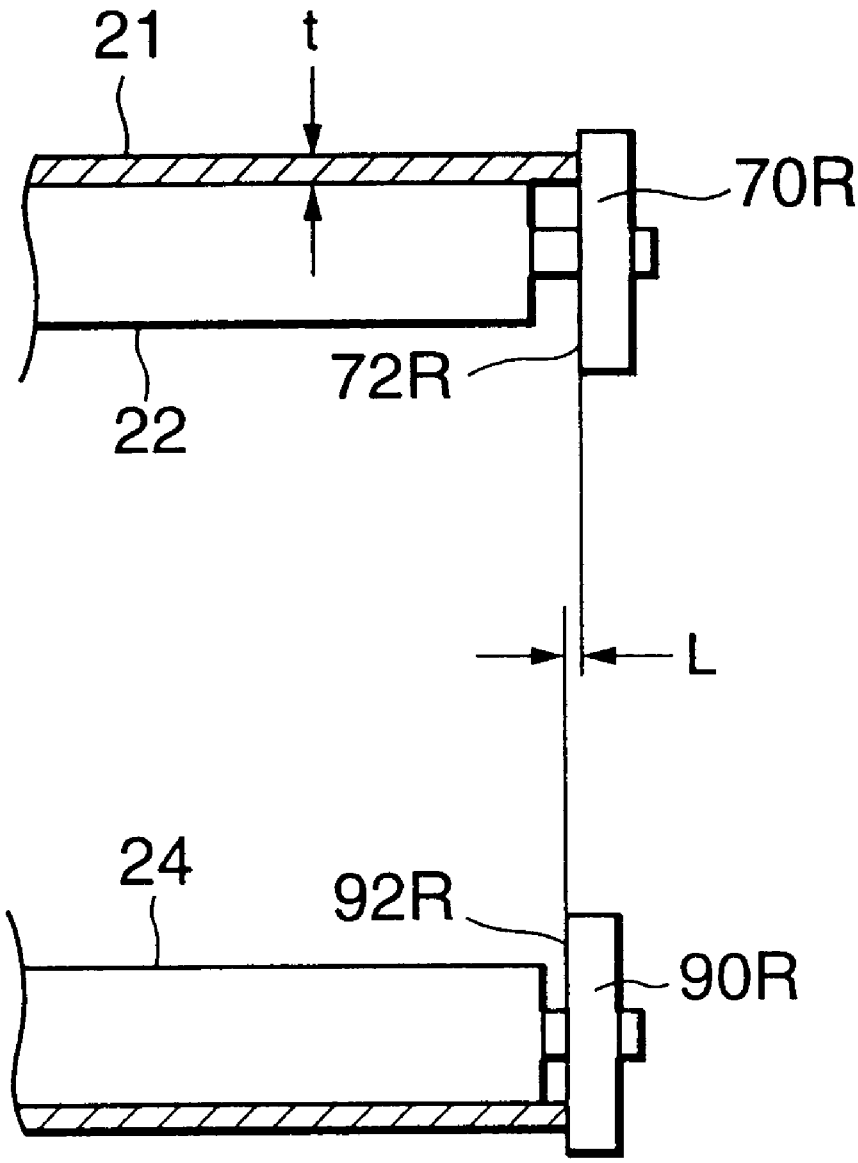
FIG. 10 is a schematic top view showing the relation between the regulation member at the driving roller side and that at th driven roller side.
Figure 11:
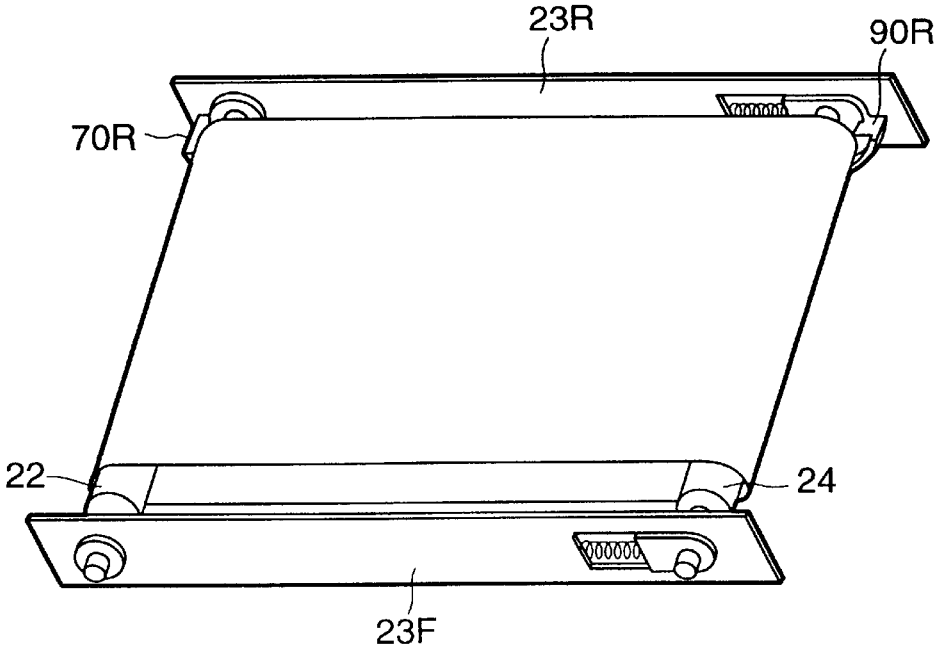
FIG. 11 is a diagonal view showing the relation between the regulation member at the driving roller side and that at the driven roller side.
Figure 12:
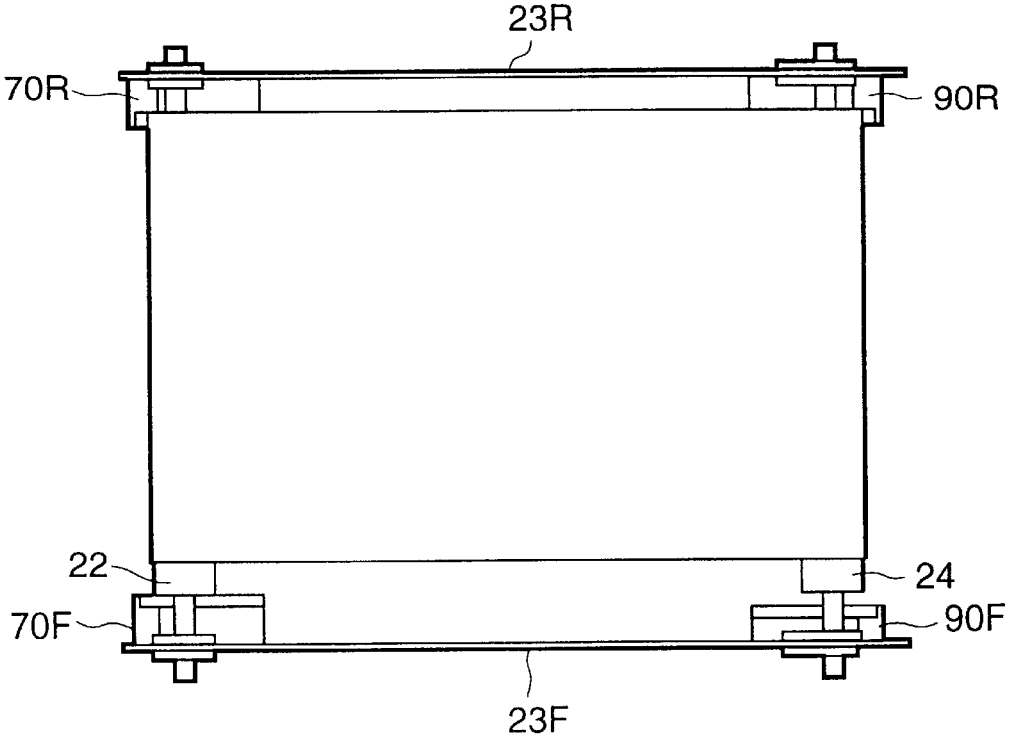
FIG. 12 is a top view showing the transfer mechanism shown in FIG. 11.
Figure 13:
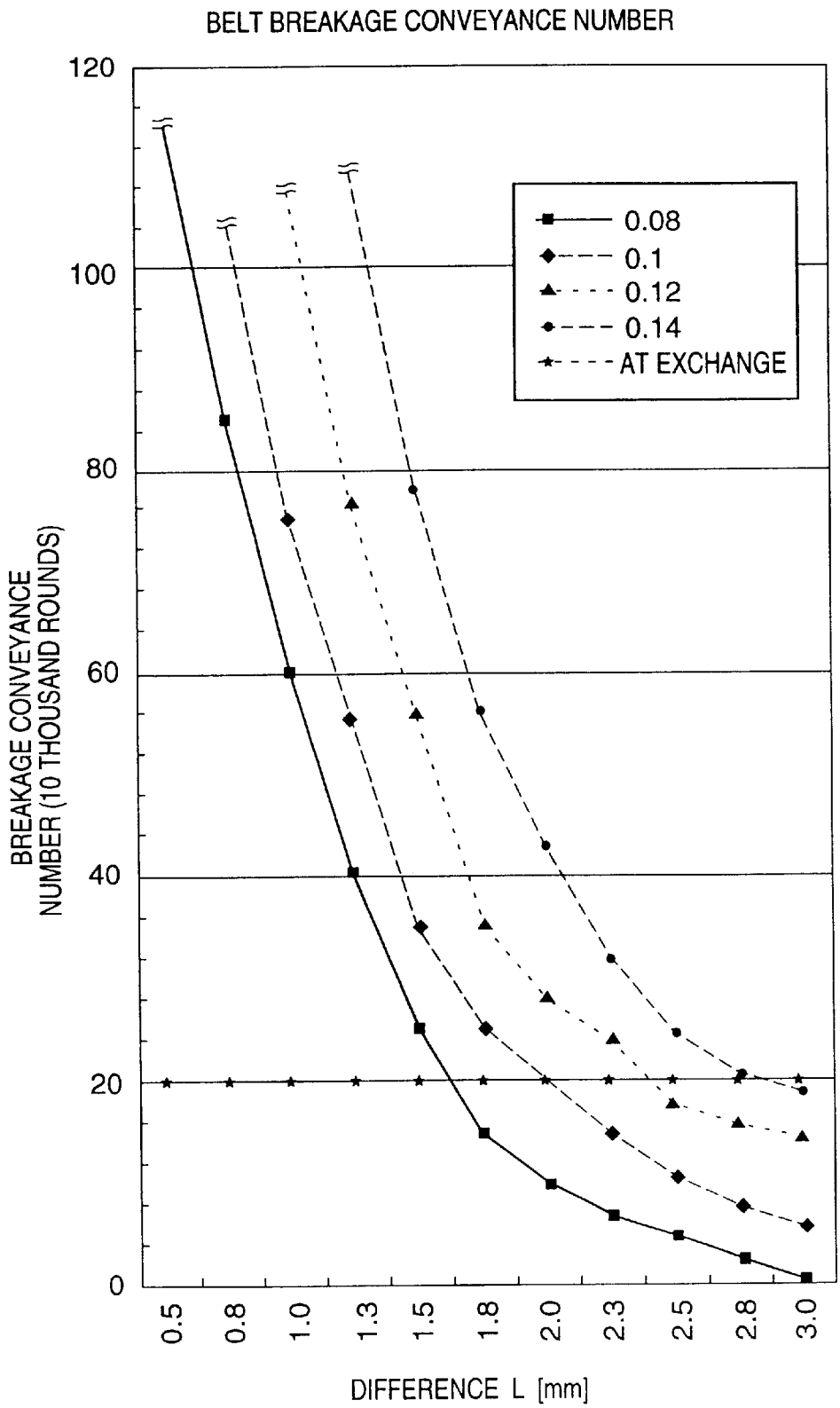
FIG. 13 is a graph showing the results of experiment to investigate the distance margin between the regulating surface of the regulation member at the driving roller side and the regulating surface of the regulation member at the driven roller side.

As the conditions for the experiment, as shown in FIG. 10, the distance L [mm] along shaft direction between the regulating surface 72R of the regulation member 70R at the driving roller 22 side and the regulating surface 92R of the regulation member 90R at the driven roller 24 side was changed gradually from 0.5 [mm] to 3.0 [mm], while the thickness t [mm] of the belt 21 was changed gradually from 0.08 [mm] to 1.4 [mm]. At this moment, the twisting force of the conveyor belt 21 to the rear side was set 1 [kg], and the conveyance speed of the conveyor belt 21 was set 200 [mm/s], but under these conditions it would take much time, therefore, an acceleration test was carried out. FIG. 13 shows the results of the acceleration test which was converted into the original conditions. By the way, in this experiment, in all the cases, it was made as completion at the stage when the running distance of the conveyor belt 21 exceeded one million rounds.

In the graph in FIG. 13, the horizontal axis is shown as L, while the vertical axis is shown as breakage conveyance number N. Herein, the service life (breakage life) of the conveyor belt 21 is set 200 thousand rounds, while the exchange interval of the-conveyor belt 21 is set 180 thousand rounds. When the service life (breakage life) of the conveyor belt 21 is set 200 thousand rounds as in this experiment, settings may be $L \leqq 1.6$ in the case where the thickness of conveyor belt 21 t=0.08, while $L \leqq 2.0$ in the case t=0.10, $L \leqq 2.4$, in the case t=0.12, $L \leqq 2.8$ in the case t=0.14, which may be read from the graph.

In other words, so as to meet the relation $L \leqq 20t$ including all the results mentioned above, by setting the distance L between the regulating surface 72R of the regulation member 70R at the driving roller 22 side and the regulating surface 92R of the regulation member 90R at the driven roller 24 side, it is possible to create conditions wherein the conveyor belt 21 will not break within the exchange interval of the conveyor belt 21.

As mentioned so far, so as to meet the relation $L \leqq 20t$, setting of the distance L between the regulating surface of the regulation member at the driving roller 22 side and the regulating surface of the regulation member at the driven roller 24 side enables to provide a highly reliable conveying mechanism 20 where the belt thereof will never break within belt exchange interval.

By the way, in the fourth preferred embodiment explained with FIG. 9, for example, when the conveyor belt 21 slides with and contacts to the regulation member 70R at the rear side of the driving roller 22, the twisting force of the conveyor belt 21 to the regulation member 70R becomes largest at the position where the lower portion of the conveyor belt 21 gets away from the driving roller 22. When the twisting force is concentrated at this position, the conveyor belt 21 will be rolled downward as the direction to let the reaction force from the regulation member 70R.

Originally, it is ideal that the twisting force of the conveyor belt 21 works vertically onto the regulating surface 72R of the regulation member 70R, and as reaction thereto, a force to push back the conveyor belt 21 vertically occurs from the regulation member 70R, however, in the case of large twisting force, the conveyor belt 21 that has combustible nature will cause deformation, as a result it will be rolled up. As one of the reasons for this, it is pointed out that the conveyor belt 21 has free degrees downward to the regulation member 70R. Namely, the conveyor belt 21 has spatial free degree in the direction where it rolls up, therefore it will be rolled up.

Therefore, in this preferred embodiment under the present invention, the regulation member 70R is configures as shown in FIG. 9, thereby the rolling up of the conveyor belt 21 is prevented. In more details, the regulation member 70R has a regulating surface 72R that makes the end of the conveyor belt 21 slide and contact thereto, and at the lower end side of this regulating surface 72R, formed is a roughly circular protrusion 74R. This protrusion 74R of the regulation member 70R is away from and faces to the external circumferential surface of the driving roller 22, and the protrusion length thereof is L, and the distance between the external circumferential surface of the driving roller 22 and the protrusion 74R is S.

As the conveyor belt 21 under twisting force is being rolled up along the regulating surface 72R of the regulation member 70R, the end of the conveyor belt 21 contacts the protrusion 74R, and receives reaction force in the vertical direction to the twisting force, thereby rolling up is prevented. And rolling up of the conveyor belt 21 is also regulated by this protrusion 74R, it is possible to prevent breakage owing to bending fatigue of rolling root portion that has been caused by rolling up of the conveyor belt 21.

TABLE 1

| | 1.0 | 1.2 | 1.4 | 1.6 | 1.8 | 2.0 | 2.2 | 2.4 | 2.6 | 2.8 | 3.0 | 3.2 | 3.4 | 3.6 | 3.8 | 4.0 | 4.2 |
|---|---|---|---|---|---|---|---|---|---|---|---|---|---|---|---|---|---|
| 0.06 | X | X | ○ | ○ | | | | | | | | | | | | | |
| 0.08 | X | X | X | X | ○ | ○ | | | | | | | | | | | |
| 0.10 | X | X | X | X | X | X | ○ | | | | | | | | | | |
| 0.12 | X | X | X | X | X | X | X | ○ | ○ | | | | | | | | |
| 0.14 | X | X | X | X | X | X | X | X | X | X | ○ | ○ | | | | | |
| 0.16 | X | X | X | X | X | X | X | X | X | X | X | X | ○ | ○ | | | |
| 0.18 | X | X | X | X | X | X | X | X | X | X | X | X | X | ○ | ○ | | |
| 0.20 | X | X | X | X | X | X | X | X | X | X | X | X | X | X | X | X | ○ |

Table 1 shows the results of the experiment with the conveyor belt having a practically upper limit Young's modulus $7\times10^4$ [kg/cm$^2$] in the present regulation member system, and the thickness T of practical conveyor belt 21 at 0.06 [mm]–0.20 [mm] as parameter.

In this experiment, twisting force was uniformly set to practical lower limit 0.1 [kg], the length L of the projection 74R of the regulation member 70R was fixed to 1.4 [mm], and the conveyor belt 21 was run, and the distance S between the external circumferential surface of the driving roller 22 to the protrusion 74R of the regulation member 70R was charged, thereby studied was whether or not there was breakage owing to rolling up the conveyor belt 21 up to 120 thousand rounds that was the exchange standard interval of the conveyor belt 21.

The experiment results are shown with ○ in the case wherein the conveyor belt 21 did not break up to the 120 thousand rounds running as the exchange target of the conveyor belt 21, while with × in the case wherein the conveyor belt 21 broke before that. As the distance S between the external circumferential surface of the driving roller 22 to the protrusion 74R of the regulation member 70R becomes larger, the conveyor belt 21 will roll up more.

In the experiment, tests were carried out per belt thickness, and when specifications were attained, for confirmation, tests were carried out further with one step higher distance S. As the results, it has found that the following relational equation stands to the practically upper limit Young's modulus $7\times10^4$ [kg/cm$^2$] in the regulating plate method, and the practical lower limit twisting force 0.1 [kg].

$$S[mm]<15T[mm]$$

The above relational equation is based on the conveyor belt 21 of the practically upper limit Young's modulus and the practical lower limit twisting force, so it is effective to the cases with the conveyor belt 21 having lower Young's modulus, and with larger twisting force too.

For example, in the case wherein Young's modulus of the conveyor belt 21 is low, the conveyor belt 21 is apt to roll up, therefore, it is necessary to make the distance S small. And in the case wherein twisting force is large, the conveyor belt 21 is apt to roll up, therefore, it is necessary to make the distance S small. Accordingly, the above relational equation has the meaning to regulate the upper limits of the distance S and the belt thickness T, thus it shows all the relations.

TABLE 2

| | 0.4 | 0.6 | 0.8 | 1.0 | 1.2 | 1.4 | 1.6 | 1.8 | 2.0 | 2.2 | 2.4 | 2.6 | 2.8 | 3.0 |
|---|---|---|---|---|---|---|---|---|---|---|---|---|---|---|
| 0.06 | ○ | ○ | ○ | X | X | | | | | | | | | |
| 0.08 | ○ | ○ | ○ | ○ | X | X | | | | | | | | |
| 0.10 | ○ | ○ | ○ | ○ | ○ | ○ | X | X | | | | | | |
| 0.12 | ○ | ○ | ○ | ○ | ○ | ○ | ○ | ○ | X | X | | | | |
| 0.14 | ○ | ○ | ○ | ○ | ○ | ○ | ○ | ○ | ○ | X | X | | | |
| 0.16 | ○ | ○ | ○ | ○ | ○ | ○ | ○ | ○ | ○ | ○ | X | X | | |
| 0.18 | ○ | ○ | ○ | ○ | ○ | ○ | ○ | ○ | ○ | ○ | ○ | ○ | X | X |
| 0.20 | ○ | ○ | ○ | ○ | ○ | ○ | ○ | ○ | ○ | ○ | ○ | ○ | ○ | X |

Table 2 shows the results of the experiment wherein the influence of the length L of the protrusion 74R of the regulation member 70R was studied, and the conveyor belt having a practically upper limit Young's modulus $7\times10^4$ [kg/cm$^2$], and the thickness T of practical conveyor belt 21 at 0.06 [mm]–0.20 [mm] as parameter were employed.

In this experiment, twisting force was uniformly set to practical lower limit 0.1 [kg], the length L of the projection 74 R of the regulation member 70R was fixed to the minimum distance to the belt thickness T obtained in the foregoing experiment, and the conveyor belt 21 was run, and the distance L between the regulating surface 72R of the regulation member 70R to the protruded end of the protrusion 74R of the regulation member 70R was changed, thereby studied was whether or not there was breakage owing to rolling up the conveyor belt 21 up to 120 thousand rounds that was the exchange standard interval of the conveyor belt 21.

The experiment results are shown with ○ in the case wherein the conveyor belt 21 did not break up to the 120 thousand rounds running as the exchange target of the conveyor belt, while with × in the case wherein the conveyor belt 21 broke before that. As the distance L to the protruded end of the protrusion 74R, there may be rolling up at the outside of the protrusion 74R, accordingly the conveyor belt 21 will roll up more.

In the experiment, tests were carried out per belt thickness, and when specifications were attained, for confirmation, tests were carried out further with one step higher distance L. As the results, it has found that the following relational equation stands to the practically upper limit Young's modulus $7\times10^4$ [kg/cm$^2$] in the regulating plate method, and the practical lower limit twisting force 0.1 [kg].

$$L[mm]<20T[mm]$$

The above relational equation is based on the conveyor belt 21 of the practically upper limit Young's modulus and the practical lower limit twisting force, so it is effective to the cases with the conveyor belt 21 having lower Young's modulus, and with larger twisting force too.

For example, in the case wherein Young's modulus of the conveyor belt 21 is low, the conveyor belt 21 is apt to roll up, therefore, it is necessary to make the protruded length L of the protrusion 74R large. And in the case wherein twisting force is large, the conveyor belt 21 is apt to roll up, therefore, it is necessary to make the protruded length L of the protrusion 74R large.

Accordingly, the above relational equation has the meaning to regulate the protruded length L of the protrusion 74R of the regulation member 70R and the lower limit of the belt thickness T, thus it shows all the relations. And further, the above explanations have been made mainly on the regulation member 70R as a representative, however the explanations are same to other regulation members 70F, 90R and 90F.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

As mentioned so far herein, the belt conveyor and the image forming apparatus equipped therewith have the structures and functions mentioned above, therefore, it is possible to make the conveyor belt for transferring a image receiving medium at a specified position in stable manners, and to remove displacement of an image to be output onto the image receiving medium that is conveyed via the conveyor belt, thereby to form quality images.

What is claimed is:

1. A belt conveyor comprising:

a driving roller;

a driven roller arranged roughly in parallel with, and away from the driving roller;

a conveyor belt wound around the driving roller and driven roller, to run endlessly by rotation of the driving roller, the conveyor belt having a conveying portion which conveys an image receiving medium and a returning portion which returns from an ending position of the conveying portion to a starting position of the conveying portion; and a regulation member arranged adjacent to at least one end of the axial direction of the driving roller, to regulate movement of the conveyor belt in the axial direction of the driving roller, wherein the regulation member has a regulating surface which is arranged at a position able to contact a side edge of the conveyor belt at only the returning portion side of the conveyor belt below a middle position between the conveying portion and the returning position where the conveyor belt winds around the driving roller.

2. A belt conveyor set forth in claim 1, wherein the regulating surface has a protruded portion that is expanded from the regulating surface in the axial direction of the driving roller along the surface of the returning portion of the conveyor belt so as to prevent the corresponding side edge of the conveyor belt from going over the regulating surface.

3. A belt conveyor comprising:

a driving roller;

a driven roller arranged roughly in parallel with, and away from the driving roller;

a conveyor belt wound around the driving roller and driven roller, to run endlessly by rotation of the driving roller, the conveyor belt having a conveying portion which conveys an image receiving medium and a returning portion which returns from an ending position of the conveying portion to a starting position of the conveying portion; and a first pair of regulation members arranged adjacent to both the ends of the axial direction of the driving roller, to regulate movement of the conveyor belt in the axial direction of the driving roller, wherein each of the first pair of regulation members has a regulating surface which is arranged at a position able to contact a side edge of the conveyor belt at only the returning portion side of the conveyor belt below a middle position between the conveying portion and the returning position where the conveyor belt winds around the driving roller.

4. A belt conveyor set forth in claim 3, wherein each of the regulating surfaces of the first pair of regulation members has a protruded portion that is expanded from the regulating surface in the axial direction of the driving roller along the surface of the returning portion of the conveyor belt to prevent the corresponding side edge of the conveyor belt from going over the regulating surface.

5. A belt conveyor set forth in claim 3, further comprising:

a second pair of regulation members that is arranged adjacent to both the ends of the axial direction of the driven roller, to regulate movement of the conveyor belt in the axial direction of the driven roller, wherein each of the second pair of regulation members has a regulating surface which is arranged at a position able to contact a side edge of the conveyor belt at only the returning portion side of the conveyor belt below a middle position between the conveying portion and the returning position where the conveyor belt winds around the driving roller.

6. A belt conveyor set forth in claim 5, wherein each of the regulating surfaces of the second pair of regulation members has a protruded portion that is expanded from the regulating surface in the axial direction of the driving roller along the surface of the returning portion of the conveyor belt to prevent the corresponding side edge of the conveyor belt from going over the regulating surface.

7. A belt conveyor set forth in claim 6, wherein if the distance along the axial direction of the following driving roller between the regulating surface of a first regulation member arranged adjacent to one end of the driving roller and the regulating surface of a second regulation member arranged adjacent to a corresponding one end of the driven roller is defined as L, and the thickness of the conveyor belt is defined as t, then the distance L is set so that $L \leqq 20\ t$.

8. A belt conveyor set forth in claim 5, wherein if the distance along the axial direction of the following driving roller between the regulating surface of a first regulation member arranged adjacent to one end of the driving roller and the regulating surface of a second regulation member arranged adjacent to a corresponding one end of the driven roller is defined as L, and the thickness of the conveyor belt is defined as t, then the distance L is set so that $L \leqq 20t$.

9. An image forming apparatus comprising:

a driving roller;

a driven roller arranged roughly in parallel with, and away from the driving roller;

a conveyor belt would around the driving roller and driven roller, and has a transfer surface to hold an image receiving medium, to run endlessly by rotation of the driving roller, the conveyor belt having a conveying portion which conveys an image receiving medium and a returning portion which returns from an ending position of the conveying portion to a starting position of the conveying portion;

regulation members arranged adjacent to both the ends of the axial direction of the driving roller, to regulate movement of the conveyor belt in the axial direction of the driving roller;

plural image carriers arranged on the conveying surface of the conveyor belt and along the running direction;

image forming means for forming a developed image on each of the image carriers; and transfer means for transferring the developed image onto the image receiving medium that is held by the conveying surface and made to go through the plural image carriers, wherein each of the regulation members has a regulating surface which is arranged at a position able to contact a side edge of the conveyor belt at only the returning portion side of the conveyor belt below a middle position between the conveying portion and the returning position where the conveyor belt winds around the driving roller.

10. A belt conveyor set forth in claim 9, wherein each of the regulation members has a protruded portion that is expanded from the regulating surface in the axial direction of the driving roller along the surface of the returning portion of the conveyor belt to prevent the corresponding side edge of the conveyor belt from going over the regulating surface.

11. An image forming apparatus comprising:

a driving roller;

a driven roller arranged roughly in parallel with, and away from the driving roller;

a conveyor belt wound around the driving roller and driven roller, and has a transfer surface to hold an image receiving medium, to run endlessly by rotation of the driving roller, the conveyor belt having a conveying portion which conveys an image receiving medium and a returning portion which returns from an ending of the conveying function to a starting position of the conveying portion;

a first pair of regulation members arranged adjacent to both the ends of the axial direction of the driving roller, to regulate movement of the conveyor belt in the axial direction of the driving roller;

plural image carriers arranged on the conveying surface of the conveyor belt and along the running direction;

image forming means for forming a developed image on each of the image carriers; and transfer means for transferring the developed image onto the image receiving medium that is held by the conveying surface and made to go through the plural image carriers, wherein each of the first pair of regulation members has a regulating surface which is arranged at a position able to contact a side edge of the conveyor belt at only the returning portion side of the conveyor belt below a middle position between the conveying portion and the returning position where the conveyor belt winds around the driving roller.

12. A belt conveyor set forth in claim 11, wherein each of the first pair of regulation members has a protruded portion that is expanded from the regulating surface in the axial direction of the driving roller along the surface of the returning portion of the conveyor belt to prevent the corresponding side edge of the conveyor belt from going over the regulating surface.

13. A belt conveyor set forth in claim 12, further comprising:

a second pair of regulation members that is arranged adjacent to both the ends of the axial direction of the driven roller, to regulate movement of the conveyor belt in the axial direction of the driven roller, wherein each of the second pair of regulation members has a regulating surface that is arranged at a position able to contact a side edge of the conveyor belt at only the returning portion side of the conveyor belt below a middle position between the conveying portion and the returning position where the conveyor belt winds around the driving roller.

14. A belt conveyor set forth in claim 13, wherein if the distance in the axial direction of the driving roller between the regulating surface of a first regulation member arranged adjacent to one end of the driving roller and the regulating surface of a second regulation member arranged adjacent to a corresponding one end of the driven roller is defined as L, while the thickness of the conveyor belt is defined as t, then L is set so that $L \leqq 20t$.

15. A belt conveyor set forth in claim 13, wherein a first regulation member arranged adjacent to one end of the driving roller and a second regulation member arranged adjacent to one end of the driven roller have respectively a protruded portion that is expanded from the regulating surface in the axial direction of the driving roller along the surface of the returning portion of the conveyor belt to prevent the corresponding side edge of the conveyor belt from going over the regulating surface.

16. A belt conveyor set forth in claim 15, wherein if the distance in the axial direction of the driving roller between the regulating surface of a first regulation member arranged adjacent to one end of the driving roller and the regulating surface of a second regulation member arranged adjacent to a corresponding one end of the driven roller is defined as L, while the thickness of the conveyor belt is defined as t, then L is set so that $L \leqq 20t$.

* * * * *